United States Patent [19]

Bushnell

[11] 4,241,914

[45] Dec. 30, 1980

[54] ELASTIC APPARATUS FOR RESISTING AND ASSISTING A PERSON PERFORMING EXERCISES

[76] Inventor: Donald D. Bushnell, 733 S. Jones, Mesa, Ariz. 85204

[21] Appl. No.: 45,273

[22] Filed: Jun. 4, 1979

[51] Int. Cl.[3] ..... A63B 21/02

[52] U.S. Cl. ..... 272/136; 272/900; 272/62; 272/142; 272/DIG. 4

[58] Field of Search ..... 272/136, 142, 135, 143, 272/DIG. 4, 101, 102, 103, 62, 70, 140, 138, 67

[56] References Cited

U.S. PATENT DOCUMENTS

| | | | |
|---|---|---|---|
| 1,472,906 | 11/1923 | Gorrell | 272/67 |
| 3,782,719 | 1/1974 | Kuhlman | 272/67 |

*Primary Examiner*—Richard C. Pinkham
*Assistant Examiner*—William R. Browne
*Attorney, Agent, or Firm*—Drummond and Nelson

[57] ABSTRACT

Apparatus for assisting or hindering a person performing exercises. The apparatus consists of a frame and at least one elongate elastic member attached at either end thereof to the frame. The yielding resistance and position of the elastic member in the frame are adjustable. The elastic member functions to assist generally upward bodily movement during an exercise when downwardly deflected by body weight before the exercise is commenced. The elastic member resists muscular exertion when deflected by such exertion during an exercise. The frame is maintained in position during performance of exercises.

1 Claim, 10 Drawing Figures

ELASTIC APPARATUS FOR RESISTING AND ASSISTING A PERSON PERFORMING EXERCISES

This invention relates to exercising apparatus.

In another aspect, this invention concerns apparatus for resisting and assisting a person performing exercises.

Exercise devices for resisting a person performing exercises are well known in the art. For example, see U.S. Pat. No. 3,701,529 to Kruthaupt, and U.S. Pat. No. 2,919,134 to Zuro. Exercise devices for assisting a person performing exercises are also known in the art. For example, see U.S. Pat. No. 3,592,465 to Fulkerson, and U.S. Pat. No. 4,111,414 to Roberts.

The known exercise assisting devices typically only assist a person in performing one specific exercise. Also, once a person can perform the exercise without assistance, the assisting devices provide no means for resisting the performance of the exercise so that the person may further increase his strength in performing a single repetition of the exercise.

The known exercise resisting devices do not allow a person to, by performing the exercise while being assisted, gradually increase his strength to the point where the exercise may be performed with resistance.

Such devices, particularly the known assisting devices, often must be relatively permanently mounted to a wall or other support and are not easily moveable for use in other locations.

Another reason such devices are sometimes difficult to move is that the weights or other means used to adjust the assistance or resistance of the devices are of substantial weight.

It would therefore be highly desirable to provide apparatus which could assist and resist a person in performing a plurality of exercises.

It would also be highly desirable to provide such apparatus which would have a lightweight and simple means for adjusting the resistance and assistance offered the person performing an exercise.

It would further be highly desirable to provide such an apparatus which was lightweight and could be easily moved for use in various other locations.

Accordingly, the principal object of the invention is to provide an exercise apparatus which will assist and resist a person in performing an exercise.

Another principal object of the invention is to provide an exercise apparatus for assisting and resisting a person in performing a plurality of exercises.

It is a further and more specific object of the invention to provide a lightweight and simple means for adjusting the resistance and assistance offered the person performing an exercise.

It is a still further and more specific object of the invention to provide a simple, rugged, and economical assisting and resisting exercise apparatus, It is a yet still further and more specific object of the invention to provide an assisting and resisting exercise apparatus which could be easily moved for use in various locations.

These and other, further and more specific objects and advantages of the invention will be apparent to those skilled in the art from the following detailed description thereof, taken in conjunction with the drawings, in which.

Briefly, in accordance with my invention, I provide apparatus for assisting and resisting a person performing exercises.

The apparatus comprises a frame, elongate elastic means attached to the frame for use in assisting and resisting a person performing exercises, means to adjust the yielding resistance and assistance of the elastic means, and means for selectively positioning the elastic means in the frame. The elongate elastic means for use in assisting and resisting a person performing exercises is responsive to yieldingly resist muscular exertion by the person when deflected by the exertion by the person during the exercises, and is responsive to yieldingly assist generally upward muscular exertion during said exercises when downwardly deflected by body weight of said person.

Figure 1:
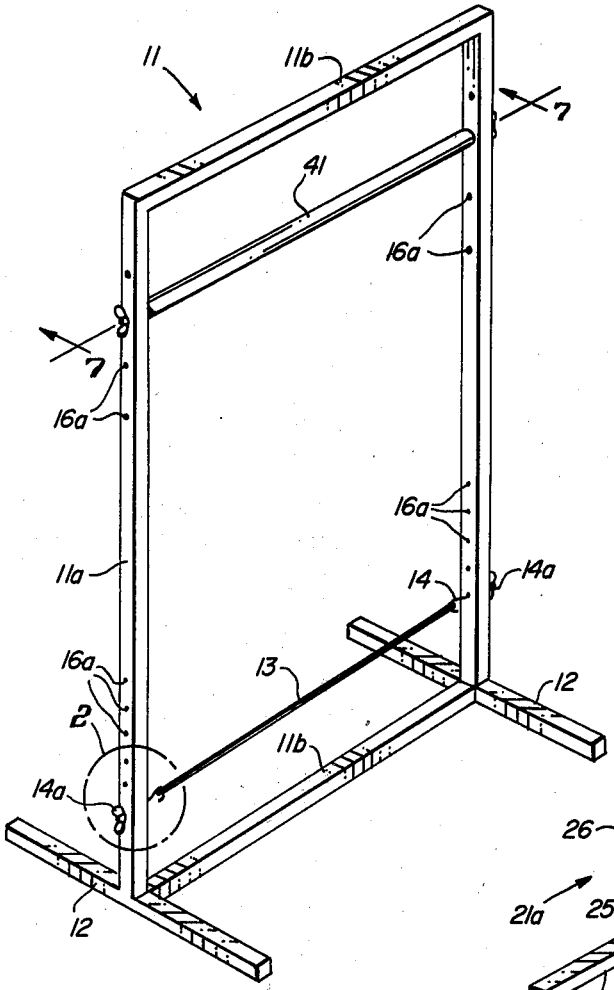
FIG. 1 is a perspective view of one form of apparatus embodying the present invention.
Figure 2:
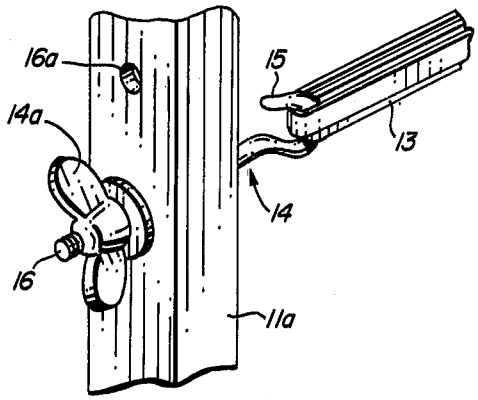
FIG. 2 is an enlarged perspective view of the mechanism for attaching elastic bands to the frame of the apparatus in FIG. 1.

Turning now to the drawings, which depict the presently preferred embodiments of the invention for the purpose of illustrating the practice thereof and not by way of limitation of the scope of the invention, FIGS. 1 and 2 illustrate one embodiment of the invention consisting of a rectangular frame 11 with parallel vertical members 11*a* and parallel horizontal members 11*b*. A plurality of holes 16*a* are spaced along the vertical members 11*a* of the frame 11. Inserts 14, externally threaded on one end 16 and hook shaped on the other end 15, are secured in the spaced holes 16*a* by placing a washer 17 on the threaded end 16 and screwing an internally threaded wing nut 14*a* onto the threaded end 16. Legs 12 are attached to the frame 11 for support. Elastic bands 13 are attached to the hook shaped ends 15 of inserts 14. A chinning bar 41 is optionally mounted in the frame 11.

Figure 3:
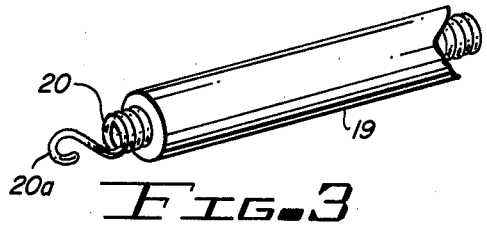
FIG. 3 is a partial perspective view of an optional elastic band construction.

FIG. 3 illustrates an optional type of elastic band 13 comprised of a spring 20 with a hooking end 20*a* and a rubber covering 19.

Figure 5:
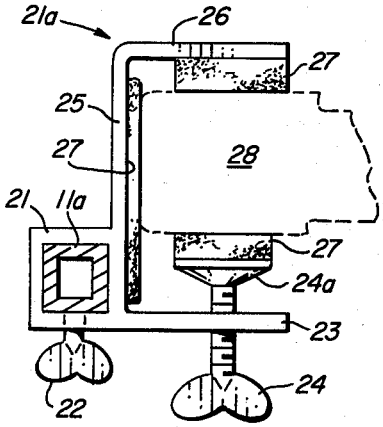
FIG. 5 is a side view of the securing bracket of FIG. 4.
Figure 4:
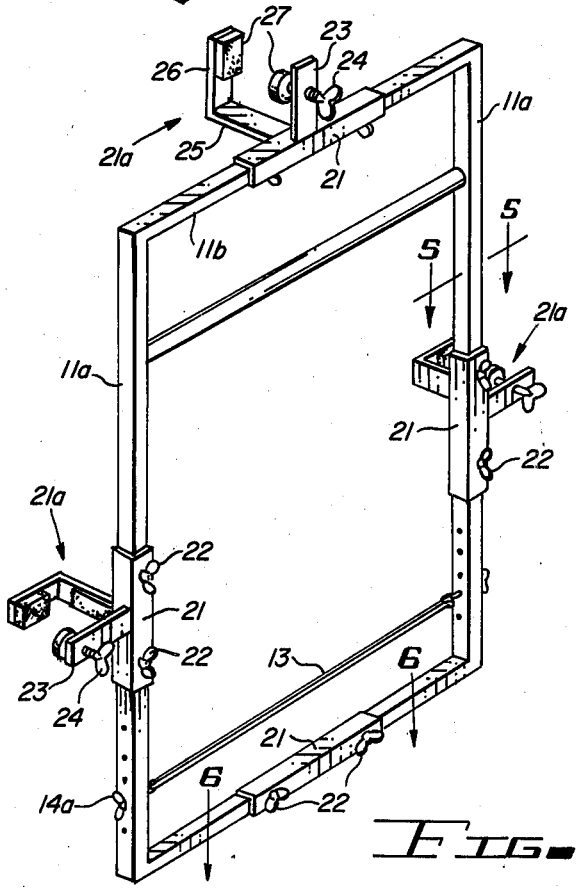
FIG. 4 is a perspective view of the apparatus in FIG. 1 optionally adapted with sleeves for adjusting the apparatus to fit various doorways and brackets for securing the apparatus to door jambs or other structures.
Figure 6:
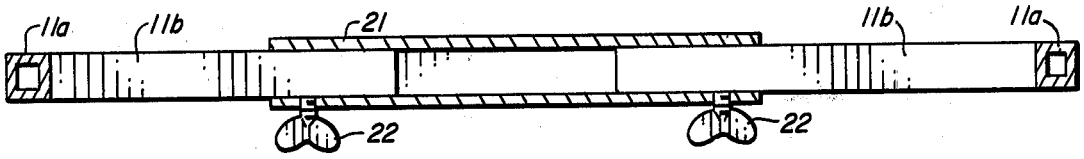
FIG. 6 is a cross-sectional view of the adjusting sleeve of FIG. 4 taken along section line 6—6.

An alternate embodiment of the invention is disclosed in FIGS. 4–6, which depict an adjustable sleeve 21, and adjustable sleeves 21 with attached U-shaped mounting brackets 21*a* placed on vertical members 11*a* and horizontal members 11*b* of the frame 11. Each of the vertical members 11*a* and horizontal members 11B is cut and separated at its center to allow adjustment of the size of the frame 11 by using the sleeves 21. The U-shaped mounting brackets 21*a* are used to attach the frame 11 to doorways or other existing structures. Winged externally threaded inserts 22 friction tighten the sleeves 21 to the frame 11. The U-shaped mounting brackets 21*a* consist of L-shaped depending projections 25 from the sleeves 21 having legs 26, and of depending projections 23 from the sleeves 21 in parallel opposition to the legs 26. Threaded inserts 24 each with a foot 24*a* are rotatably mounted in the projections 23 to fasten the brackets 21*a* to the door jamb shown by the dashed lines 28. Padding 27 is optionally attached to the bracket 21*a*.

Figure 7:
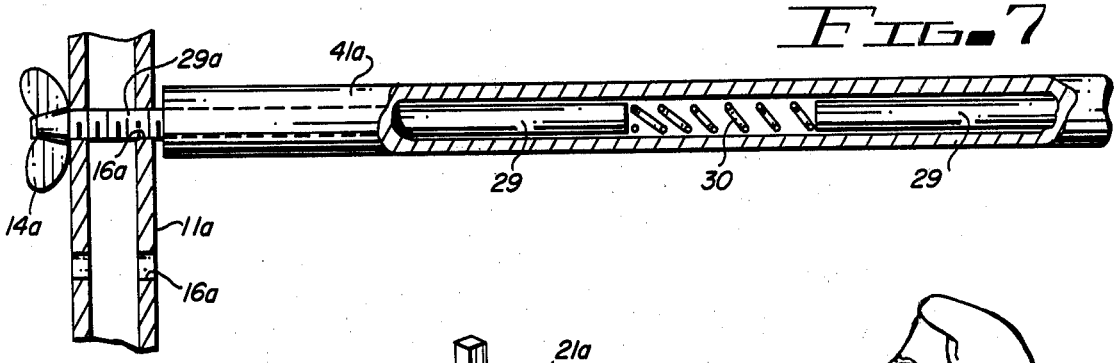
FIG. 7 is a partial sectional side view of the chinning bar of FIG. 1.

FIG. 7 illustrates the chinning bar 41, consisting of rubber tubing 41*a* encasing a spring 30 outwardly forcing rods 29. Each rod 29 has an externally threaded end 29*a*. A hole 16*a* receives the threaded end 29*a* of the rod 29. The internally threaded nut 14*a* screws onto the threaded end 29*a*.

Figure 8:
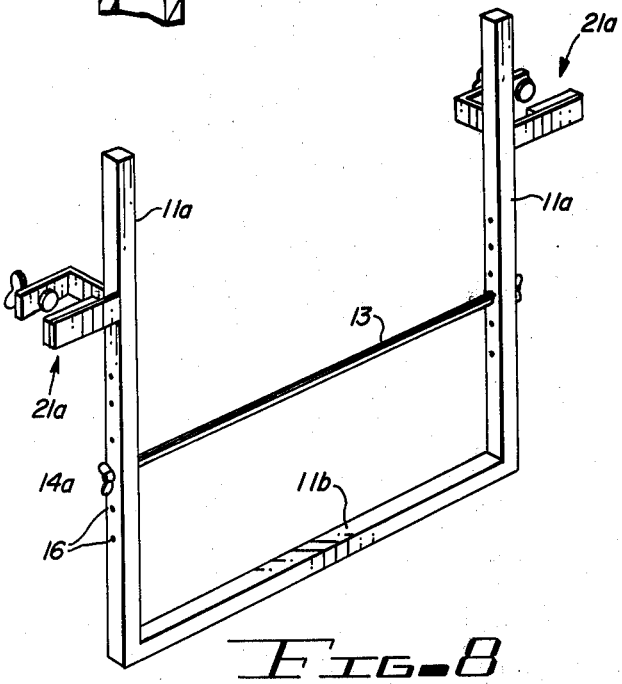
FIG. 8 is a perspective view of an alternative form of apparatus embodying the present invention.

FIG. 8 discloses a further embodiment of the invention. Mounting brackets 21*a* are directly attached to vertical members 11*a*. This embodiment is specifically useable in conjunction with an existing chinning bar in a doorway.

Figure 9:
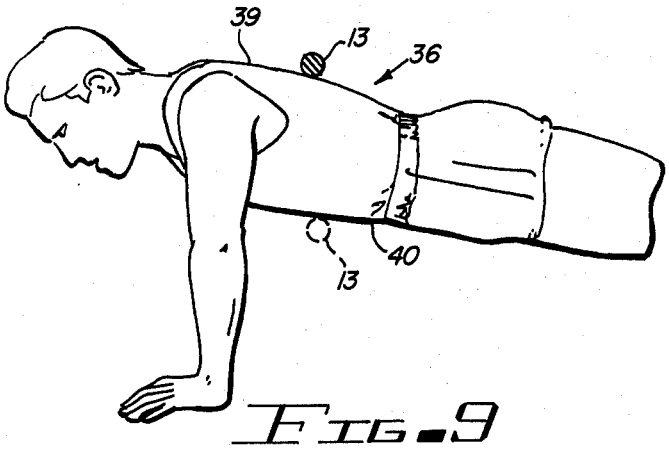
FIG. 9 is a partial side view of the apparatus of FIG. 1 illustrating the mode of operation.

As shown in FIG. 9 the apparatus of FIGS. 1–8 may be employed to assist or resist a person 36 performing push-ups. The person 36 is assisted in performing a push-up when the elastic bands 13 are downwardly deflected beneath and are contacting the torso 40 of the person 36. The person 36 is resisted in performing a push-up when the elastic bands 13 are upwardly deflected and are contacting the back 39 of the person 36.

Figure 10:
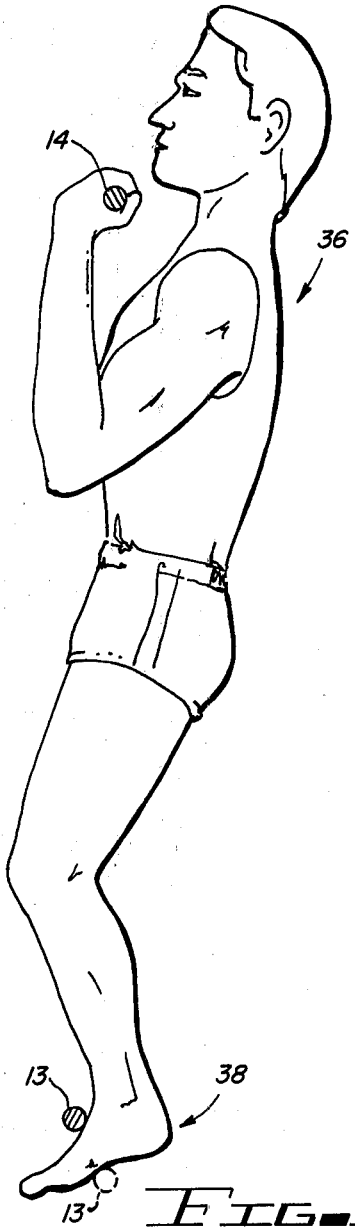
FIG. 10 is a partial side view of the apparatus of FIG. 1 further illustrating the mode of operation thereof.

Similarly, FIG. 10 illustrates the apparatus of FIGS. 1–8 being employed to assist or resist a person 36 performing a chin-up. The person 36 grasping the chinning bar 41 is assisting in performing a chin-up when the elastic bands 13 are downwardly deflected and are contacting the bottom of the feet 38 of the person 36. The person is resisted in performing a chin-up when the elastic bands 13 are upwardly deflected and are contacting the top of the feet 38 of the person 36.

Having described my invention in such terms as to enable those skilled in the art to understand and practice it, and having identified the presently preferred embodiments thereof, I claim:

1. Apparatus for resisting and assisting a person performing exercises comprising (a) a frame;

(b) elongate tensioned elastic means, attached at both ends thereof to said frame and responsive (i) to yieldingly resist muscular exertion by said person when deflected by said exertion by said person during said exercises, and (ii) to yieldingly assist generally upward bodily movement during said exercises when downwardly deflected by body weight of said person before said exercise is performed, said upward bodily movement occurring during said muscular exertion against at least one surface substantially fixed in position during said exercise;

(c) means to adjust the yielding resistance and assistance of said elastic means;

(d) manual means for selectively varying the position of the entire length of said elastic means in said frame; and (e) means for maintaining said frame in a fixed position during the performance of said exercises.

* * * * *